US008025171B2

(12) United States Patent
Cassol et al.

(10) Patent No.: US 8,025,171 B2
(45) Date of Patent: Sep. 27, 2011

(54) FUEL TIN

(75) Inventors: Michele Cassol, Eschlikon (CH); Beat A. Knabenhans, Erlenbach (CH); Walter Rufener, Matzingen (CH)

(73) Assignee: Firestar AG, Eschlikon (CH)

( * ) Notice: Subject to any disclaimer, the term of this patent is extended or adjusted under 35 U.S.C. 154(b) by 1011 days.

(21) Appl. No.: 10/523,954

(22) PCT Filed: Aug. 8, 2003

(86) PCT No.: PCT/IB03/03562

§ 371 (c)(1),
(2), (4) Date: Aug. 18, 2005

(87) PCT Pub. No.: WO2004/016514

PCT Pub. Date: Feb. 26, 2004

(65) Prior Publication Data

US 2006/0102630 A1 May 18, 2006

(30) Foreign Application Priority Data

Aug. 14, 2002 (WO) ..... PCT/IB02/03251

(51) Int. Cl.
*B65D 17/34* (2006.01)

(52) U.S. Cl. .... 220/270; 126/45; 220/257.2; 220/258.5; 220/239; 220/906; 222/541.9

(58) Field of Classification Search ..... 126/45; 220/257.2, 258.5, 239, 270, 906; 222/541.9
See application file for complete search history.

(56) References Cited

U.S. PATENT DOCUMENTS 3,159,303 A 12/1964 Betner
3,435,977 A * 4/1969 Jacke ..... 215/255
3,701,454 A 10/1972 Thorp
3,720,349 A 3/1973 Brown
3,811,817 A * 5/1974 Mansnerus et al. ..... 431/126
3,850,124 A 11/1974 Brown
4,593,834 A 6/1986 Hoft et al.
4,604,053 A 8/1986 De La Rosa
4,690,297 A 9/1987 Hoft et al.
4,850,858 A 7/1989 Blankenship et al.
4,896,653 A 1/1990 Eke et al.
5,193,521 A * 3/1993 Levinson et al. ..... 126/45

(Continued)

FOREIGN PATENT DOCUMENTS

CH 690 317 A5 7/2000

(Continued)

OTHER PUBLICATIONS

English Abstract of RU 2 186 012 dated Jul. 27, 2002.

(Continued)

*Primary Examiner* — Anthony Stashick
*Assistant Examiner* — Elizabeth Volz
(74) *Attorney, Agent, or Firm* — Sughrue Mion, PLLC

(57) ABSTRACT

The invention relates to a fuel paste tin, comprising a dished tin body (1) and a sealing lid (3), fixed to the tin body (1) with two pre-scored lines (6), along which a partial lid section (7) may be removed from the sealing lid (3) by breaking a material connection to generate a precisely defined opening (4, 10, 11) in the sealing lid (3). The invention permits the production of fuel paste tins with may be employed directly as paste burners with a desired burn capacity and burn duration, which are economic to produce and cause little litter.

25 Claims, 13 Drawing Sheets

U.S. PATENT DOCUMENTS

| | | | | |
|---|---|---|---|---|
| 5,934,498 | A | 8/1999 | Jordan | |
| 6,194,479 | B1 | 2/2001 | Tabakovic | |
| 6,302,290 | B1 | 10/2001 | Engelaere | |
| 6,592,363 | B2 * | 7/2003 | Hoffmann | 431/320 |

FOREIGN PATENT DOCUMENTS

| | | | |
|---|---|---|---|
| DE | 1 586 927 | | 5/1967 |
| DE | 78 16 145 | U | 9/1978 |
| EP | 0 283 534 | A | 9/1988 |
| EP | 0 540 133 | A2 | 5/1993 |
| FR | 2 624 104 | | 6/1989 |
| JP | 49-15799 | U | 4/1974 |
| JP | 53-49791 | U | 11/1978 |
| JP | 57-15231 | U | 3/1982 |
| JP | 59-147090 | A | 8/1984 |
| JP | 63-8734 | U | 3/1988 |
| JP | 3016615 | U | 10/1995 |
| JP | 9-24960 | A | 1/1997 |
| JP | 3064443 | U | 1/2000 |
| JP | 2000-159274 | A | 6/2000 |
| NL | 7 407 468 | A | 9/1974 |
| RU | 2 173 292 | | 9/2001 |
| RU | 2 186 012 | | 7/2002 |
| SU | 768543 | | 6/1978 |
| SU | 1389674 | | 4/1988 |
| SU | 1431672 | | 10/1988 |
| WO | 00 44634 | A | 8/2000 |

OTHER PUBLICATIONS

English Abstract of JP2001/322666.
English Abstract of CH 690317 Dated Jul. 31, 2000.
English Abstract of FR 2 624 104 Dated Jun. 9, 1989.
Partial English translation of SU 768,543 of Jun. 7, 1978.
Partial English translation of JP 3064443.
Partial English translation of JP 3016615.
Partial English translation of JP 59-147090.
Partial English translation of JP 49-15799.
Partial English translation of JP 53-49791.
Partial English translation of JP 57-15231.
Partial English translation of JP 63-8734.
Partial English translation of JP 2000-159274.
Partial English translation of JP 9-24960.

* cited by examiner

FUEL TIN

TECHNICAL FIELD

The invention relates to a fuel can, a cover lid formed by a sealing foil for such a fuel can, a sealing foil for the production of such a cover lid as well as the use of the fuel can as a heat and/or light source in accordance with the preambles of the independent claims.

PRIOR ART

Fuel cans with a fuel filling and a cover lid are widely used as small containers for providing fuel for burners for stoves and consist in a known design of an aluminum cup filled with a fuel paste with a peel-off foil cover, which for use is placed, after the foil lid has been removed, into a burner for a stove, which provides in the area of the surface of the fuel a burner opening and several air feed openings. These fuel cans are economical regarding the production and cause relative little waste, but need, however, a suitable burner for their intended use.

Also known are cans with a fuel paste filling which consist, similar to a paint can, of a tin plate can with a upwards converging opening and a clamping lid, whereby the converging opening serves, after the removal of the lid, as burner opening. By means of this, the fuel can indeed can directly be used as burner, but is, however, costly regarding the production and causes a relative big amount of waste.

SUMMARY OF THE INVENTION

Thus, it is the object to provide a fuel can and a cover lid for a fuel can which do not have the above mentioned drawbacks of the prior art or avoid these at least partly.

This object is met by the fuel can and the cover lid according to the independent claims.

In a first aspect of the invention, the fuel can, which is foreseen as non-returnable container for heating and/or lightening reasons, includes a cup or bowl like can body with a fuel filling as well as a cover lid, which closes the can body tightly and is firmly connected to same, which can be obtained for instance by a welding or glueing of the cover lid to the can body, in particular by a heat sealing thereof onto the can body or by border crimping. The cover lid comprises one or several predetermined breaking locations, at which one or several lid portion elements are connected in a material bonded manner, i.e. by forming a one-piece structure, by glueing or by welding or soldering, respectively, to the remainder of the cover lid, so that a partial or complete severing and/or detaching of these lid portions from the remainder of the cover lid or out of the same is possible manually and without the use of any tools and, thereby, one or several precisely defined openings in the cover lid are produced. The planar extent of these openings is distinctly smaller than the total surface of the cover lid or the surface of a fuel filling in the can body at a medium filling level, respectively. The predetermined breaking locations can be produced as areas weakened by a punching or removal of material or as glued areas. As fuel filling, all fillings are foreseen which provide after the severing or detaching of the lid portion elements at the opening produced thereby a fuel in a combustible state, and preferably in such a manner that it cannot be spilled at least at room temperature and immediately after the opening. Thereby, the fuel fillings must not necessarily be formed exclusively by the fuel, but can also include wicks and absorbent substrate materials for an immobilizing and/or as wicks for the fuel, which especially in such cases is meaningful, when fuels which are liquid at room temperature, e.g. diethylene glycol, are used. By the invention, fuel cans can be realized, which can directly be employed as heat source, e.g. as burner for a stove or as light source, with a desired rating and combustion duration, are economical to produce and safe in operation and cause little waste.

In a preferred embodiment of the fuel can, the predetermined breaking locations are designed in such a manner that the severable or detachable, respectively, cover lid portion(s) are not completely separated from the lid after a complete separating of the predetermined breaking locations, but remain undetachably connected to same. By means of this, all components of the fuel can remain together, which facilitates the disposal and additionally provides the possibility to reclose the partly used can at least provisorily.

In a further preferred embodiment of the fuel can, the cover lid is designed in such a manner that by a peeling-off of one or several lid portions elements designed as peeling-off foil elements, at least a part of the openings produced by the severing and/or detaching of lid portion elements can be uncovered, whereby it is preferred that such a peeling-off foil element extends uninterrupted across the entire cover lid. The peeling-off foil elements cover, therefore, openings in lid portions located underneath and can be peeled off by disconnecting their glued connection with the lid portions, which form the predetermined breaking locations, wherewith the openings are exposed. This design results in the advantage that the severable and/or detachable lid portion elements can be made of a material which is different from the remainder of the lid, which in use gets hot and thus leaves little choice regarding the selection oft the material, and that possible problems when disconnecting the material bond along the predetermined breaking location have practically no influence on the geometry of the opening to be exposed. It is also possible to use a multi-layer foil with a peel-off foil cover layer for the production of the cover lid and to locate the desired openings already in all layers of the foil except the peeling-off foil cover layer by a punching, so that upon the peeling-off of the peeling-off foil cover layer the punched portions are automatically removed from the openings.

In still a further preferred embodiment of the fuel can, the cover lid is designed in such a manner that at least a part of the openings can be produced by a detaching of partial areas from the actual cover lid, thus prior to their detaching are one-piece with the cover elements which define the openings to be produced. The wording "actual cover" denominates here the structural member(s), which after the removing of the severable or detachable cover portion elements remain at the can body and define the openings. By means of this, the advantage is gained that the cover lid can be made from a single layer of a semi-manufactured product, e.g. foil or sheet metal, wherewith especially simple and economical lids can be realized.

In yet a further preferred embodiment, the cover lid of the fuel can is designed in such a manner that by the severing or detaching, respectively, of single or several cover portion elements, one or several openings with differing geometries and areas of the openings can be produced selectively and/or the number of openings can selectively be set. By means of this, e.g. differing lid portion elements may be present, which depending from the desired duration of combustion and rating, can be severed or detached or also remain untouched. By means of this, it is possible to produce, in a simple manner, from the fuel can in accordance with the invention, depending from the specific fuel and other design, a heating and/or light source specifically adapted for the respective application.

Preferably, the cover lid of the fuel can according to the invention substantially consists of a foil or a sheet metal, in the latter case preferably of an aluminum sheet, because these materials are economically available as semi-finished products and can be processed to a cover lid according to the invention by only a few and relatively simple production steps. The term "substantially" is here to be understood that at least those areas of the cover lid, which after the removing of the severable or detachable, respectively, cover portion elements remain at the can body, are made of such a material.

If the cover lid consists, thereby, of a sealing foil which preferably is formed from several different material layers, it can be sealed onto a flange-like rim of the can body by simple means, wherewith a safe and leak-proof connection between cover lid and can body can be arrived at.

In this case it is preferred to use a sealing foil which includes besides the sealing layer at least two metal foils consisting preferably of aluminum, which are extensively interconnected with each other via a synthetic material layer, preferably polyethylene, located between them.

If, thereby, a first one of the two metal foils, preferably the one which faces away from the can body, is weakened or interrupted along the predetermined breaking location, whereas the other metal foil is continuous in the area of the predetermined breaking location, a fuel tight lid with a high strength and with a reliably seperable predetermined breaking location is arrived at.

At all embodiments, the lid portion elements, for an ease of the severing or detaching, preferably comprise opening aids, which preferably are designed as pulling flaps or pulling rings and preferably project over the outer boundary of the fuel can, e.g. as extension of the cover lid, so that they can be gripped by hand. In case of pulling flaps, grooves are preferably present at the transition from the flap into the actual lid which facilitate a start of the tearing apart at the predetermined breaking locations.

By advantage, the cover lid is designed in such a manner that upon the severing or detaching, respectively of the lid portion elements, an opening or openings with an opening pattern results which has two axis of symmetry, whereby it is preferred that the axis of symmetry substantially intersect in a vertical axis through the center of the can body. By means of this, it can be ensured that in operation an as symmetric as possible flame aspect is arrived at and an even combustion of the fuel contained in the can body occurs.

Preferrably, the cover lid is designed in such a manner that by the severing or detaching, respectively, of the lid portion elements an opening, in the claims denominated as central opening, can be produced in the area of the center of the fuel can, which has substantially the same shape like the surface of the fuel contained in the tin body, in particular at a medium filling level, and is concentrically arranged relative to same. This design provides the advantage that the limits of the fuel surface practically everywhere have the same distance to the limits of the central opening, which in operation serves as burner opening, wherewith a uniform combustion of the fuel is facilitated.

It is, thereby, preferred that the central opening is substantially circular or quadratic and preferably has an area which corresponds to at least 15%, preferably to at least 20% of the surface area of the fuel filling, in particular at a medium level of fill. By means of this, an even burner rating and a stable flame aspect is arrived at during the entire duration of combustion. The expression "substantially circular or quadratic" means that this opening has a shape which is circular or quadratic or is approximated to a circular or quadratic shape, in the case of the circular shape e.g. by a uniform polygon.

If additionally at least one strip-like opening element extends from the central opening radially outwards, which extends preferably up to the edge of the cover lid, it is possible to produce an opening pattern by a detaching of one single lid portion element, in which the central opening acts exclusively as burner opening, while the strip shaped opening element(s) serve as air supply openings. By means of this, an especially stable flame pattern and a high rating is arrived at.

It is, thereby, of advantage when the transition between the central opening and the strip like opening elements extending radially outwards is smooth or harmonic, respectively, because by this, abrupt changes of the shape, which could lead to problems during the severing at the predetermined breaking locations, can be avoided. It is especially preferred that the central opening forms together with a radially outwards extending strip-shaped opening element a pear-shaped lid portion element.

Preferably, the cover lid is designed in such a manner that by the severing or detaching of preferably exactly one lid portion element an opening pattern is arrived at in which two strip-shaped opening elements located opposite of each other by 180° extend from the central opening outwards. Such an arrangement facilitates a trouble-free detaching of the lid portion from the cover lid.

Similar advantages as those described above are arrived at when upon the severing or detaching further small, preferably substantially circular openings can be produced in addition to the center opening, whereby it is preferred that these surround the central opening concentrically and with a uniform pitch.

When the cover lid is designed in such a manner that by the severing or detaching the material bond between the lid portion element and the adjacent lid area, which is sealing, is irreversibly abolished along the predetermined breaking location, partly used or opened, respectively, fuel cans can be distinguished in a simple way from new, closed ones.

For a can body, preferably a deep drawn cup or a deep drawn bowl of aluminum or tin plate is used, because such can bodies can be produced at low cost, generate little waste after use and furthermore can be recycled, whereby it is especially advantageous when the can body and the cover lid are made of substantially identical materials.

In a preferred embodiment of the fuel can, the fuel filling consists of a fuel paste with or without wick, preferably of a filling with a weight of 80 g to 100 g or 150 g to 300 g of thickened ethyl alcohol, isopropanol or methanol, whereby in this case due to the low ignition temperatures no wick is needed. Such fuel cans can excellently be used as burners for stoves.

In another preferred embodiment of the fuel can, the fuel filling consists of a fuel which is solid at room temperature with or without wick, whereby it is preferred to use polyethylene glycols, stearin, paraffin, hydrocarbon-derivates, waxes, waxe-like fuels or their derivates, respectively, or a mixture thereof with a wick. In particular when using fuel fillings with stearin and/or paraffin enriched with scents, it is possible to provide in this manner lightening means combined with an additional scent action, which can be stored in a unused state for a long time without being thereby detrimental to the scent action.

Preferably, the fuel filling consists of a liquid or solid fuel, which is immobilized by absorption in an absorbent, preferably cotton or fleece like material, such as e.g. mineral or glass wool, cellulose or cotton, i.e. can not be poured out when it is open. The absorbent material hereby preferably at the same time has the function of a wick, as far as such is necessary. By this design it is possible to safely use also fuels which are liquid at room temperature, such as diethylene glycol, or fuels which are solid at room temperature and become liquid during combustion, such as polyethylene glycol.

A second aspect of the invention refers to a cover lid made of sealing foil, preferably for a fuel can in accordance with the first aspect of the invention. Thereby, the sealing foil which forms the cover lid comprises a predetermined breaking location and includes, apart from the sealing layer, two metal foils, preferably of aluminum, which are extensively interconnected with each other via a synthetic material layer located between them, of which a first one is weakened or interrupted along the predetermined breaking location, whereas the second one is preferably continuous at the area of the predetermined breaking location. The synthetic material layer present between them and interconnecting them is preferably polyethylene (PE).

A third aspect of the invention refers to a sealing foil for the production of a cover lid according to the second aspect of the invention. The sealing foil thereby includes, in addition to the sealing layer, at least two metal foils which are extensively interconnected with each other via a synthetic material layer located between them, and specifically preferably two aluminum foils, which are inter-connected with each other via a layer of polyethylene. Such sealing foils are specifically well suitable for the production of cover lids for fuel cans according to the first aspect of the invention, because they are fuel proof, can easily be mounted onto the can body and can easily be provided with a predetermined breaking location.

A fourth aspect of the invention refers to the use of the fuel can according to the first aspect of the invention as thermal, heat and/or light source, in particular as burner for a stove or as lamp.

BRIEF DESCRIPTION OF THE DRAWINGS

Further embodiments, advantages and uses of the invention become apparent from the dependent claims and the now following description with reference to the drawings. There is shown in:

MODES FOR CARRYING OUT THE INVENTION

Figure 1A:
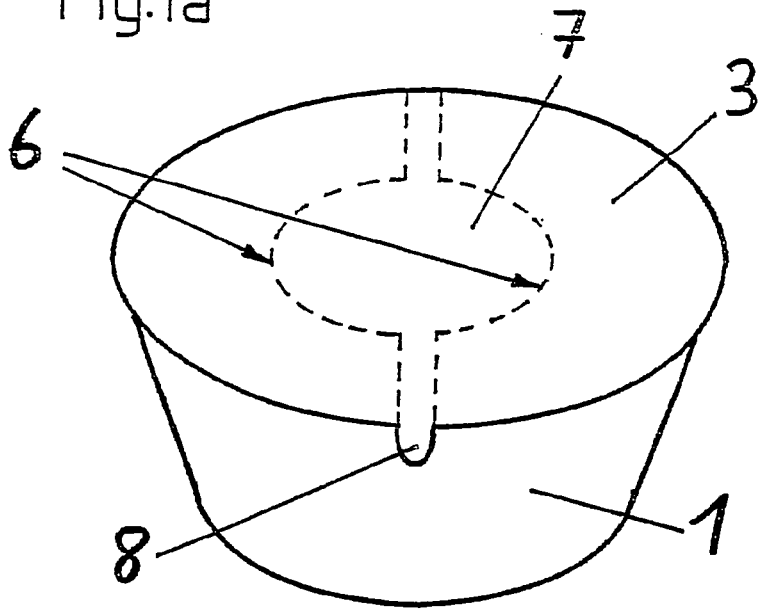
FIG. 1*a* a perspective view of a fuel can in accordance with the invention with a one-piece foil cover lid with a detachable subarea in the not opened state.
Figure 1B:
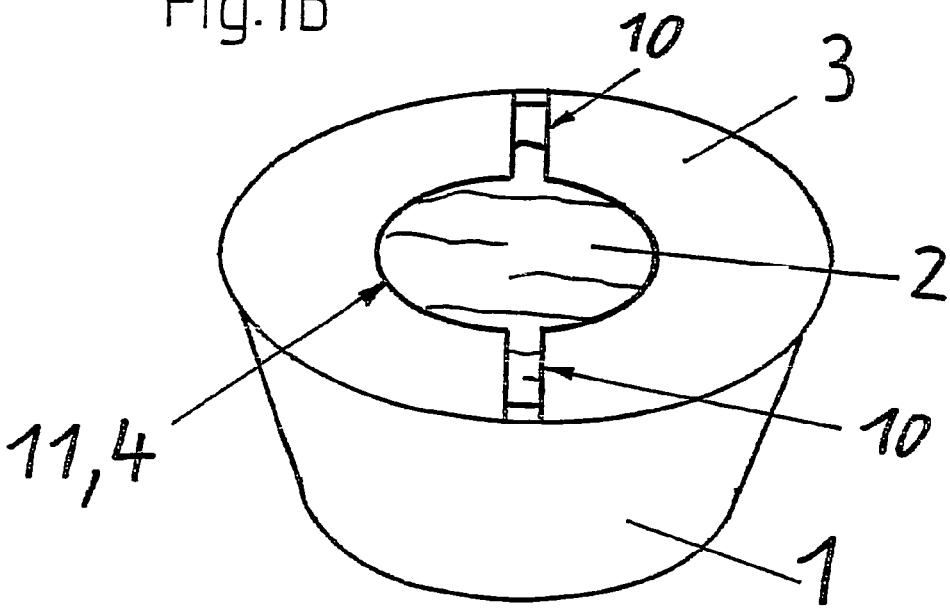
FIG. 1*b* a perspective view of the fuel can according to FIG. 1*a* in opened state.

The basic principle of the invention can be recognized by means of the FIGS. 1*a* and 1*b*, which illustrate perspective views of a fuel can in accordance with the invention, once in the not opened state (FIG. 1*a*) and once in the opened state (FIG. 1*b*). As can be seen, the fuel can consists of a can body 1 in the form of a deep drawn aluminum can with a flange-like rim, which is filled with a fuel 2, in the present case with a fuel paste 2 of thickened ethyl alcohol, and a cover lid 3 in the form of a multi-layer sealing foil which is firmly and tightly connected to the can body 1 by a sealing onto the flange-like rim.

As can be seen in FIG. 1*a*, the cover lid 3 comprises in the not opened state a cover portion element 7, which is designed as a subarea of the cover lid 3 which is detachable along two predetermined breaking locations 6 (broken lines). The predetermined breaking locations 6 have been produced in that the foil forming the cover lid 3 has been weakened along the lines illustrated as broken lines, in the present case by a punching or a burning away by laser of a few but not all material layers of the foil, so that a continuous thight and material bonded connection between the cover portion element 7 and the areas of the cover lid 3 bordering same remains preserved. As can further be seen, the detachable cover portion element 7 sporadically extends up to the edge of the cover lid 3 and ends there at one location in a pulling flap 8, which projects over the outer borders of the fuel can and by means of which the cover portion element 7 can be manually detached from the cover lid 3 without the use of any tools by a pulling upwards of the pulling flaps 8. During the detaching of the cover portion element 7, the material bonded connection to the adjacent lid areas is irreversibly disconnected along the predetermined breaking locations 6.*by* a tearing apart of the not punched through or burnt off material layers, wherewith the cover portion element 7 is completely severed from the cover lid so that a re-closing of the opened fuel can is not possible and furthermore it can be detected as being already opened.

As can be seen in FIG. 1*b*, which illustrates the fuel can after the removal of the cover portion element 7, the cover lid 3 is in the present case designed in such a manner that the detaching of the cover portion element 7 results in an opening 4 with an opening pattern with two axis of symmetry, which intersect in a vertical axis through the center of the fuel can. Thereby, the opening 4 consists of a circular central opening 11, which is concentrically arranged relative to the circular surface of the fuel filling in the can body 12, and from which two strip shaped opening form elements 10 extend radially outwards up to the edge of the cover lid. The two strip shaped opening form elements 10 are located directly opposite each other, i.e. they have a common longitudinal axis which extends through the center of the center opening 11.

Figure 2:
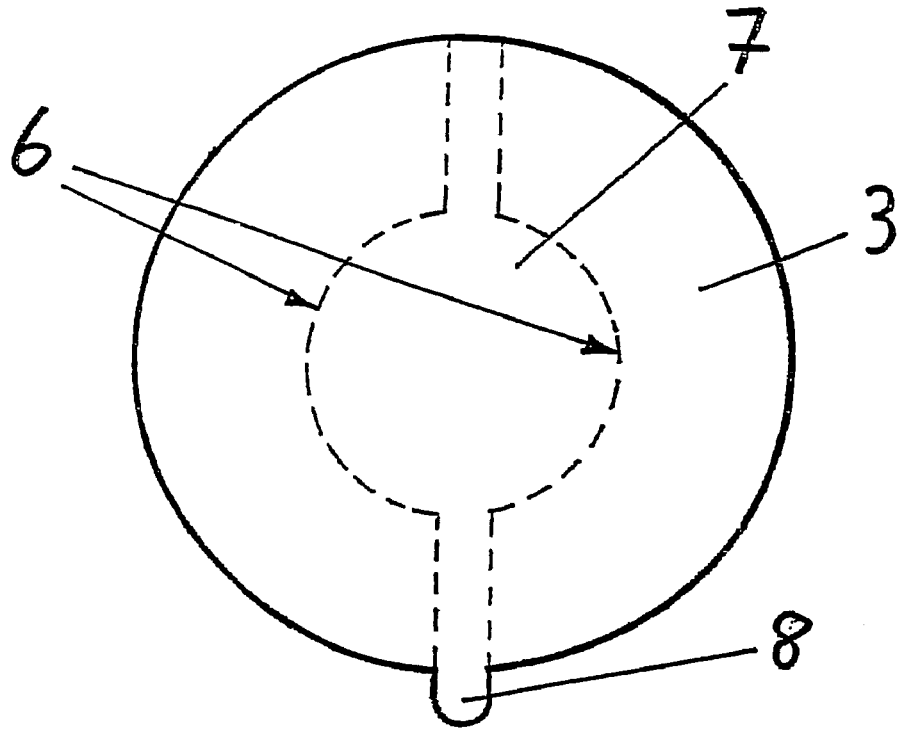
FIG. 2 a top view onto the fuel can of FIG. 1*a;*
Figure 3:
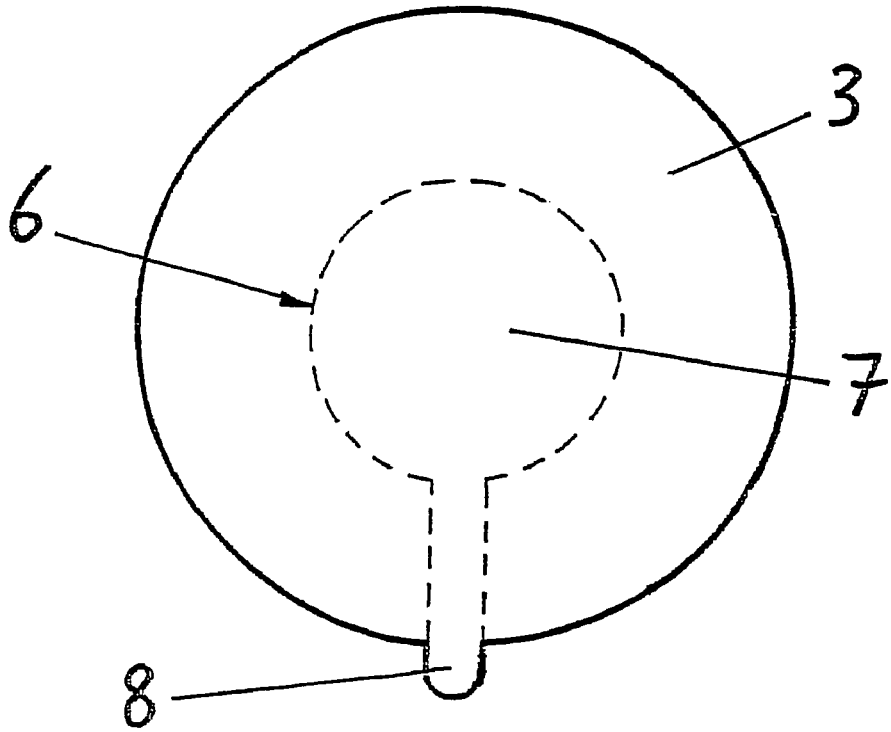
FIG. 3 to FIG. 12 top views onto further fuel cans according to the invention with integral foil-cover lids with detachable subareas.
Figure 4:
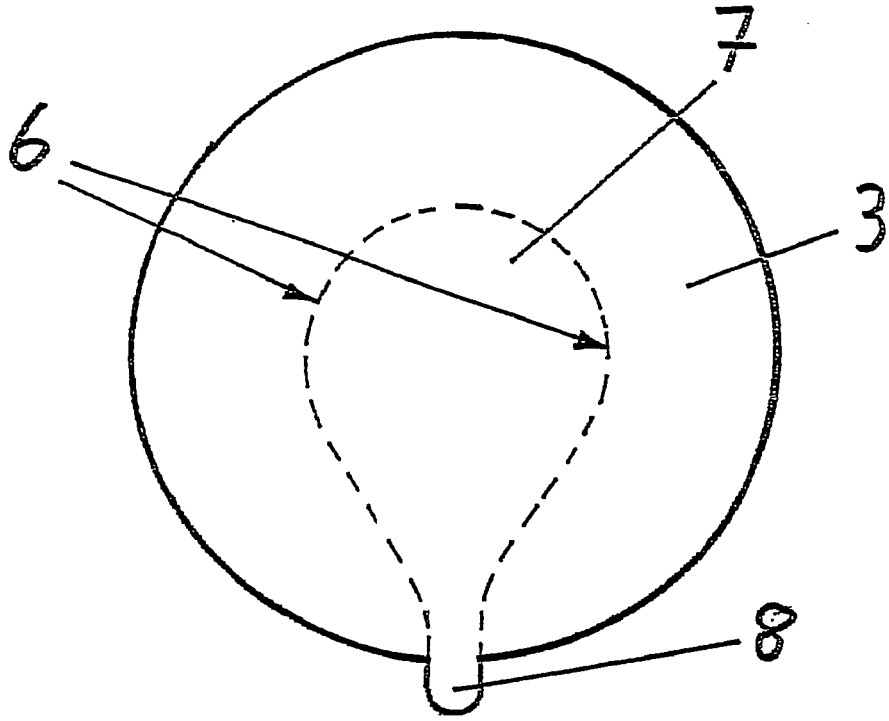

In the FIGS. 2 to 12, top views onto further fuel cans in accordance with the invention, also with cover lids 3 of a multilayer sealing foil with completely or partly detachable subareas 7 in the not opened state are illustrated, whereby FIG. 2 illustrates a top view onto the already described fuel can.

The FIGS. 3 to 10 illustrate respective top views onto fuel cans of which the cover lid 3 comprises a single detachable cover portion element 7, whereby upon a detaching of same along the predetermined breaking location various opening patterns result, namely at the fuel cans illustrated in the FIGS. 3 to 7 opening patterns with only one axis of symmetry (FIG. 3 circle with a strip shaped opening element, FIGS. 4 and 5 pear-shaped openings, FIG. 6 sector of a circle, FIG. 7 segment of a circle) and at the remaining fuel cans opening patterns with two axes of symmetry extending perpendicular relative to each other (FIG. 8 shape of a lemon, FIG. 9 shape of a strip, FIG. 10 rhomb with two strip shaped opening pattern elements located opposite of each other), which furthermore intersect in a vertical axis through the center of the can body 1 and thereby lead to a burner geometry which promotes a stable flame and a uniform combustion of the fuel during operation.

Figure 5:
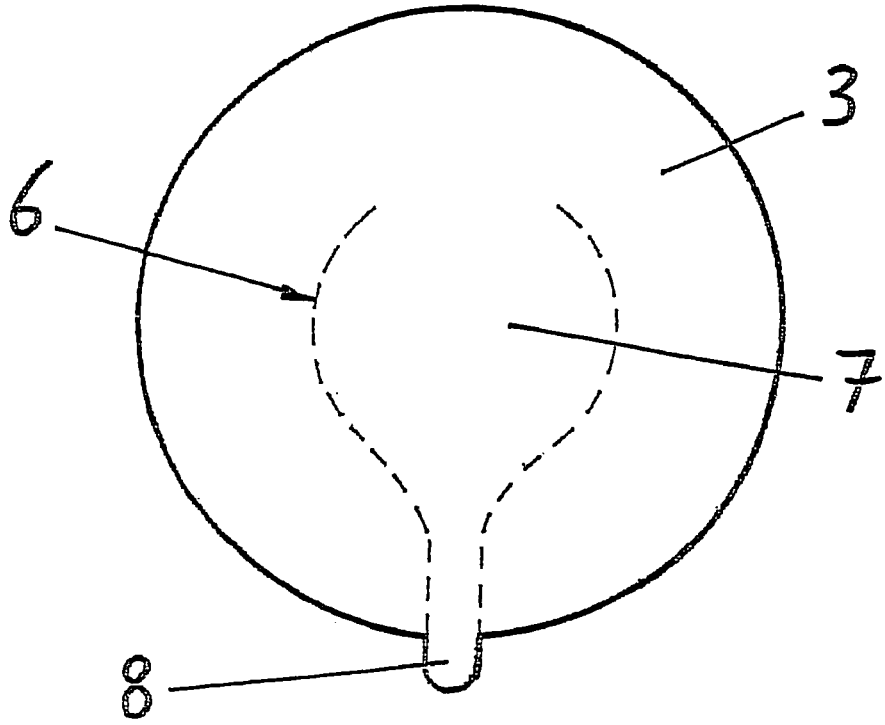
Figure 6:
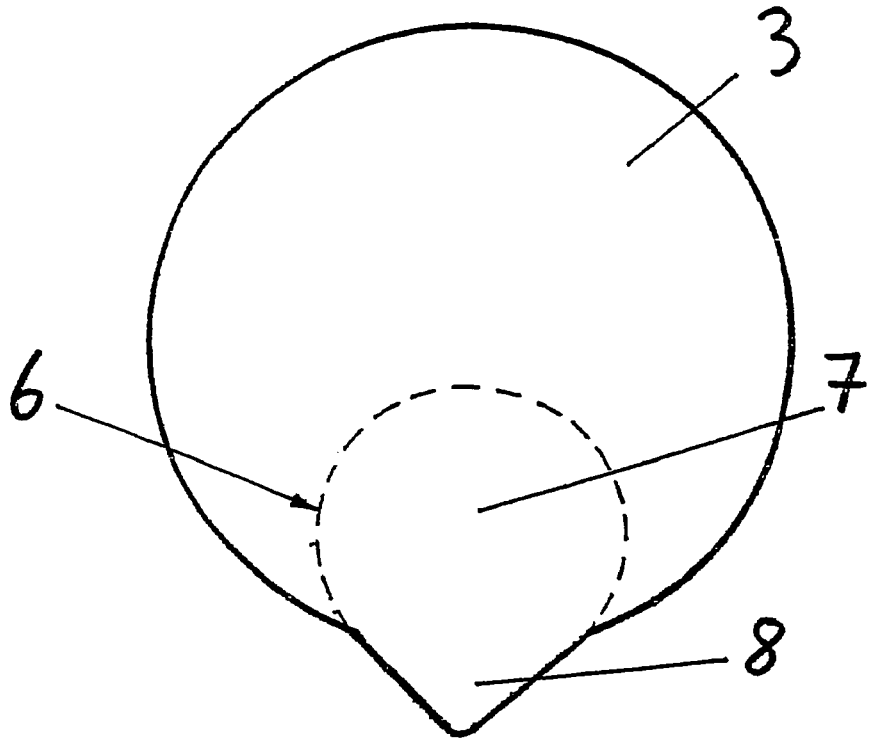
Figure 7:
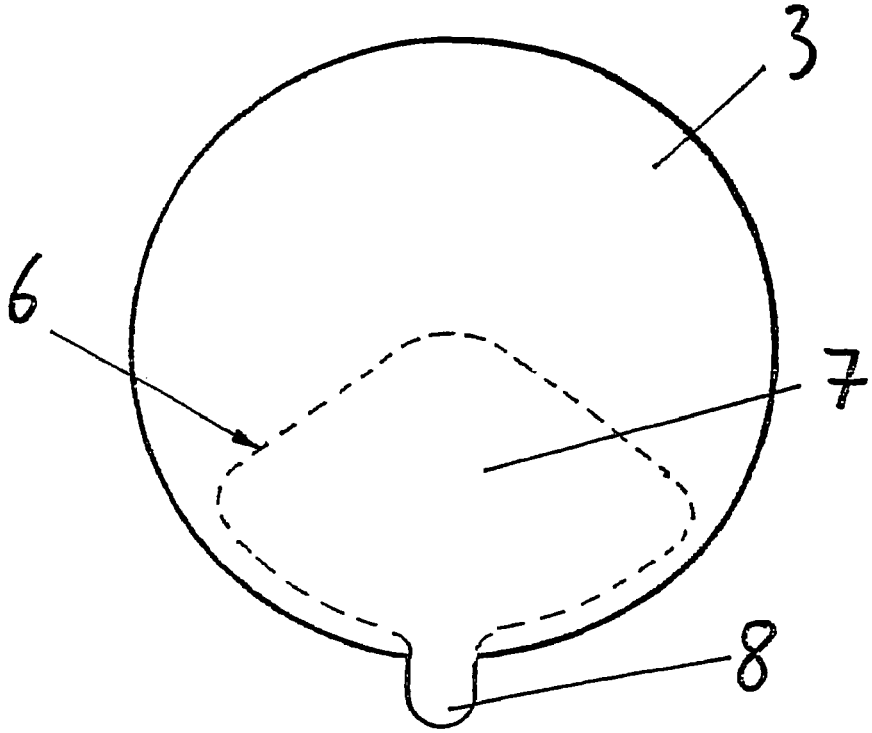
Figure 8:
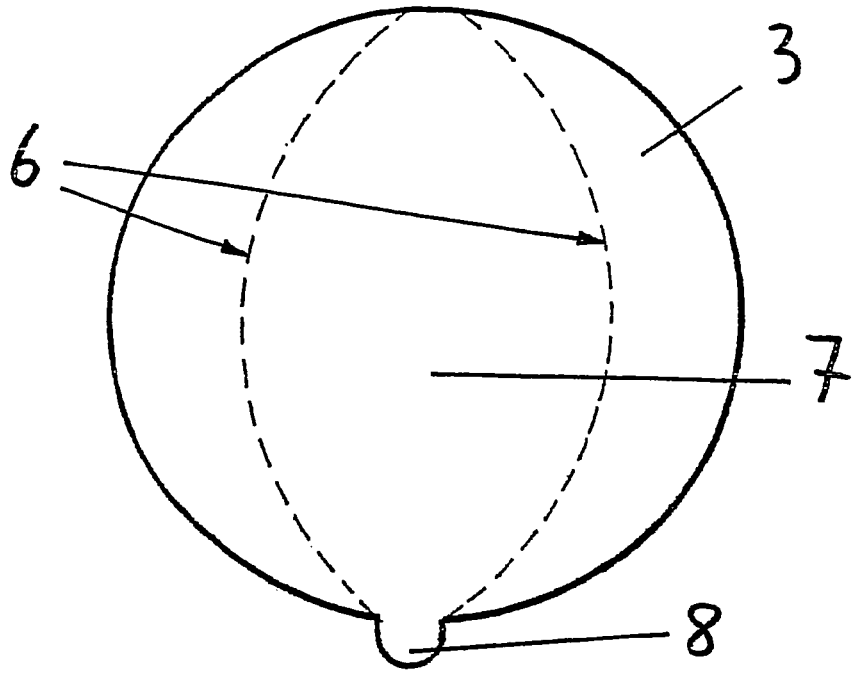
Figure 9:
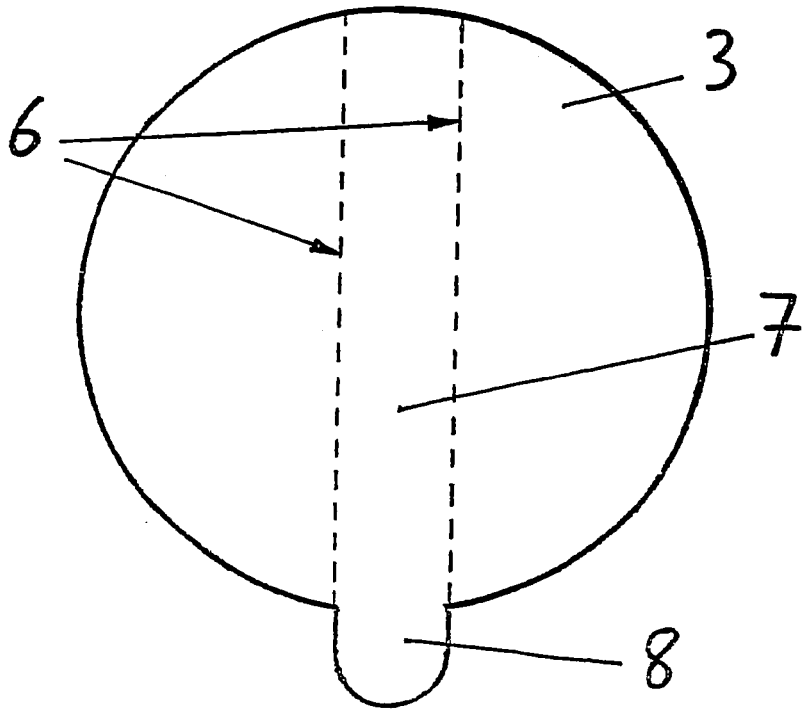

At the fuel can illustrated in FIG. 5, the predetermined breaking locations 6 end within the planar extent of the cover lid 3, so that here an only partly detachable subarea 7 is present, which after the separation of the predetermined breaking locations remains undetachably connected to the cover lid 3, so that it can be flipped over when the fuel can is in use and upon an interruption of the operation can again be flipped over the opening which it has uncovered in order to cover same during non-use.

Figure 10:
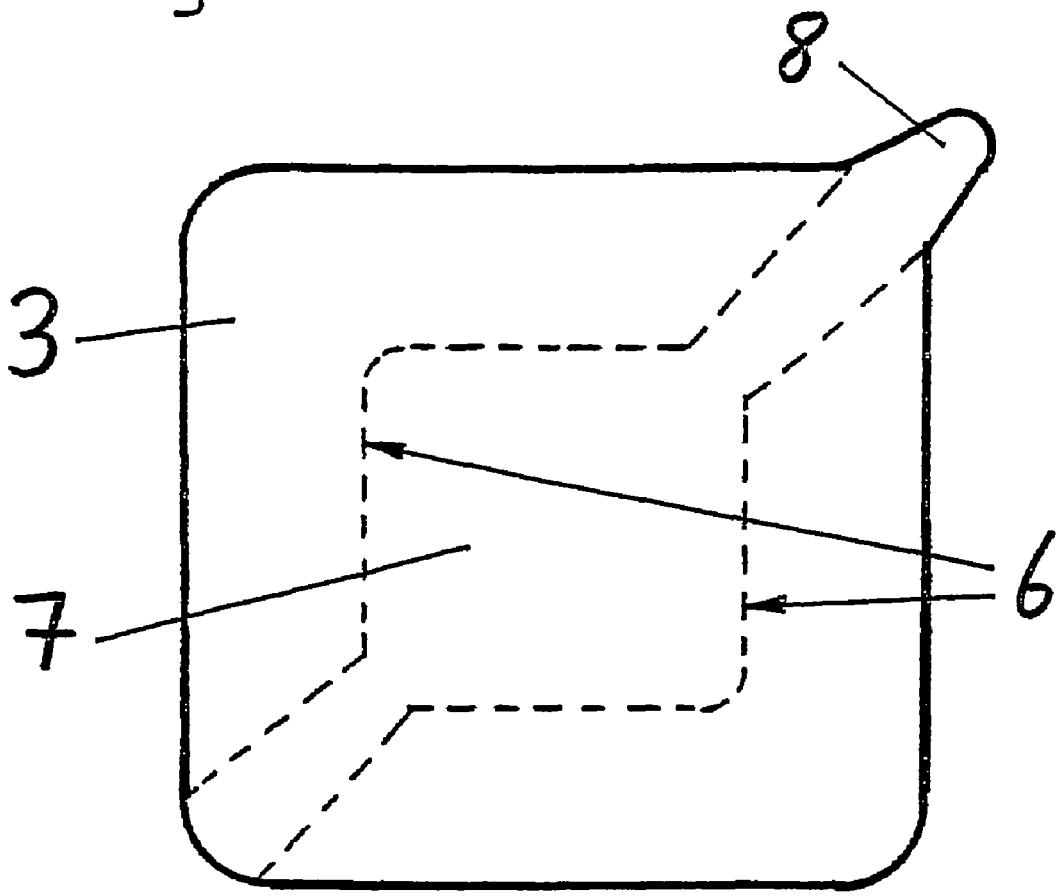

In contrast to all other illustrated fuel cans, the fuel can illustrated in FIG. 10 comprises a quadratic bowl as can body 1. Through this, such fuel cans require especially little space during transport and storage. As can be seen at the predetermined breaking locations 6 illustrated by broken lines, the cover lid is designed here, as already at the fuel can of FIG. 2, in such a manner that upon a detaching of the cover portion element 7 a center opening results, which has substantially the same shape as the surface of the fuel filling in the can body, thus in the present case a substantially quadratic shape, and which additionally is concentrically arranged to this surface. Additionally, after the removing of the cover portion element 7, two strip shaped opening form elements which widen outwards extend from two opposite located corners of the quadratic center opening to the corresponding corners of the cover lid 3. This design favours in operation a separation of the entire opening in burner zone (quadratic center opening) and air supply zones (strip shaped opening form elements) which by the way also applies for the opening patterns of the fuel cans illustrated in the FIGS. 1 to 5 and 11 and 12.

Figure 11:
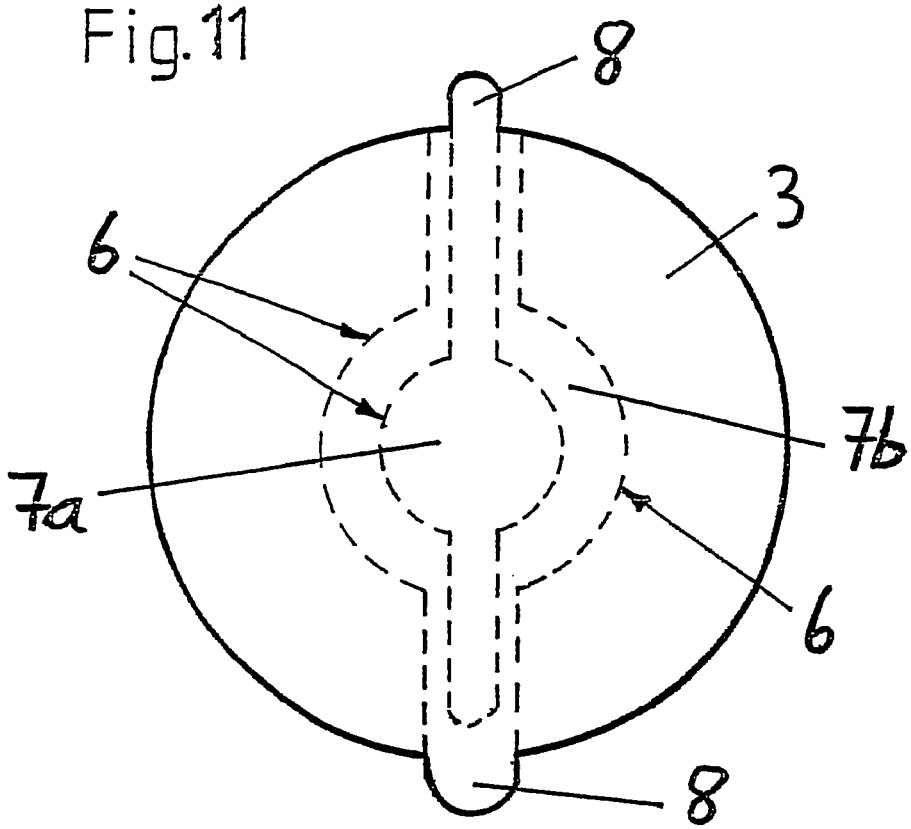
Figure 12:
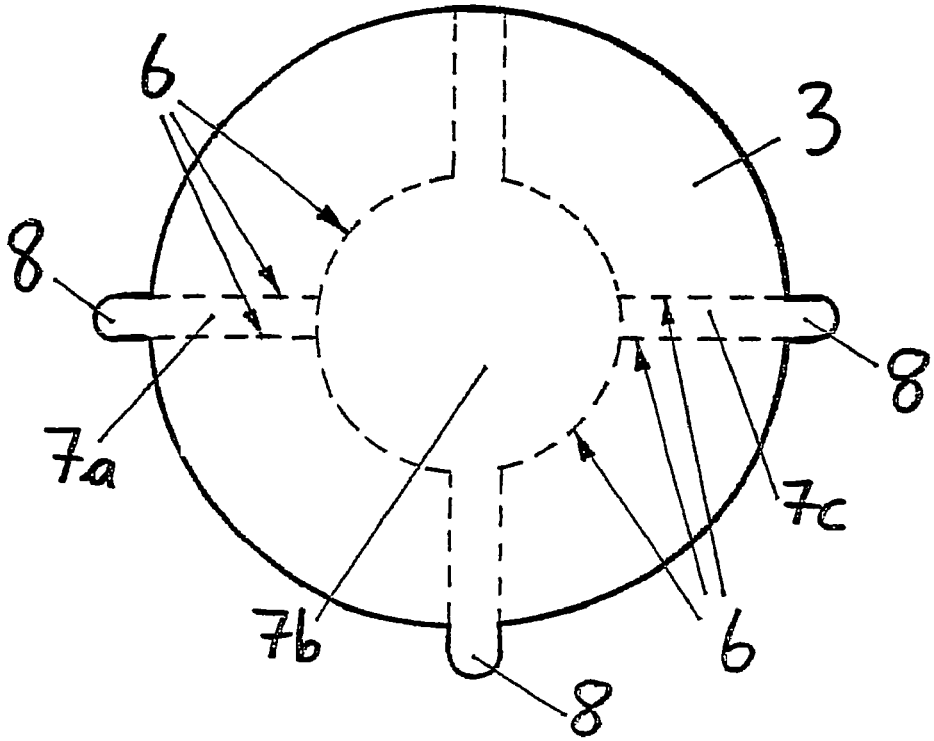

FIGS. 11 and 12 illustrate, in contrast to the previously illustrated fuel cans which exclusively comprise a foil cover lid 3 with one single detachable cover portion element 7, such cans, at which the cover lid 3 includes two (FIG. 11) or three (FIG. 12), respectively, cover portion elements 7*a*, 7*b* or 7*a*, 7*b*, 7*c*, respectively, which are detachable along the predetermined breaking locations 6. Each of the cover portion elements 7 extends thereby up to the edge of the cover, where it ends in a pulling flap 8 projecting over the contour of the fuel can, by means of which is it manually detachable from the cover lid 3.

As can be taken from the predetermined breaking locations 6 illustrated by broken lines in FIG. 11, the cover lid 3 of this fuel can is designed in such a manner that depending from the desired burner rating and duration of combustion either the cover portion element 7*a* (for a lower burner rating and a longer duration of combustion) or the cover portion element 7*b* (for a higher burner rating and a shorter duration of combustion) can be detached, whereby in the latter case the cover portion element 7*a* is automatically detached together with the cover portion element 7*b*. After the detaching, in both cases an opening geometry similar to the one already described in FIG. 1*b* is arrived at, however in each case with center openings 11 of different size and strip shaped opening form elements 10 of differents widths.

As can be taken from the predetermined breaking locations 6 illustrated by broken lines in FIG. 12, the cover lid 3 of this further embodiment of the fuel can according to the invention is designed in such a manner that, after the detaching of the cover portion element 7*b*, an opening is arrived at which regarding shape and size is identical to the one in FIG. 1*b*. Additionally, it is here possible to also detach the cover portion elements 7*a* and 7*c*, wherewith an opening pattern with a higher symmetry is reached, which leads to an increased burner rating and a more uniform combustions of the fuel filling in operation.

FIGS. 13 to 17 illustrate top views onto further fuel cans according to the invention, which in contrast to the previously shown are equipped with cover lids of sheet aluminum. Also here, the cover lids 3 include in the not opened state cover portion elements 7, 7*a*, 7*b*, which are designed each as subareas of the cover lid 3 which are detachable along a predetermined breaking location 6. The predetermined breaking locations 6 have been produced at these embodiments in that the metal sheet forming the cover lid 3 has been weakened along the lines illustrated by broken lines, in the present case by embossing of corresponding grooves in the surface of the metal sheet.

In order to facilitate a detaching of the cover portion elements, each cover portion element 7, 7*a*, 7*b* includes a pulling ring 9, by means of which, through a flapping upwards, first a portion of the cover portion element 7, 7*a*, 7*b* can be bent inwards towards the inside of the can under a rupturing of the sheet metal at a location of the predetermined breaking location 6, and thereafter the entire cover portion element 7 can be detached from the cover lid 3 by a pulling at the pulling ring 9 under a further separating along the predetermined breaking location 6. By means of this, the material bonded connection with the adjacent cover areas is irreversibly disconnected along the predetermined breaking locations 6, so that also here a re-closing of the opened fuel can is not possible and it can be recognized without any doubts as being already opened.

Figure 13:
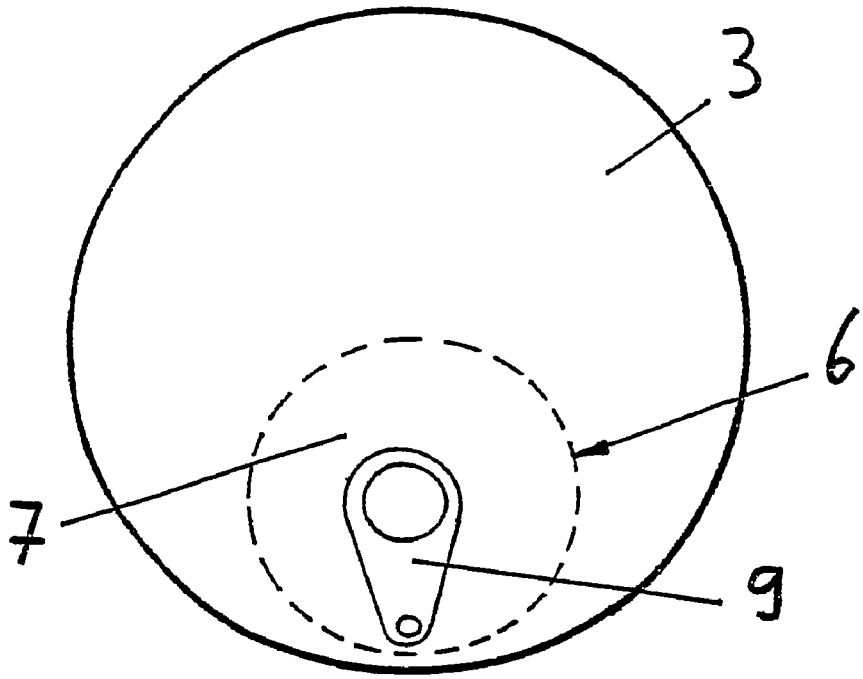
FIG. 13 to FIG. 17 top views onto further fuel cans according to the invention with cover lids of sheet metal with detachable subareas.
Figure 14:
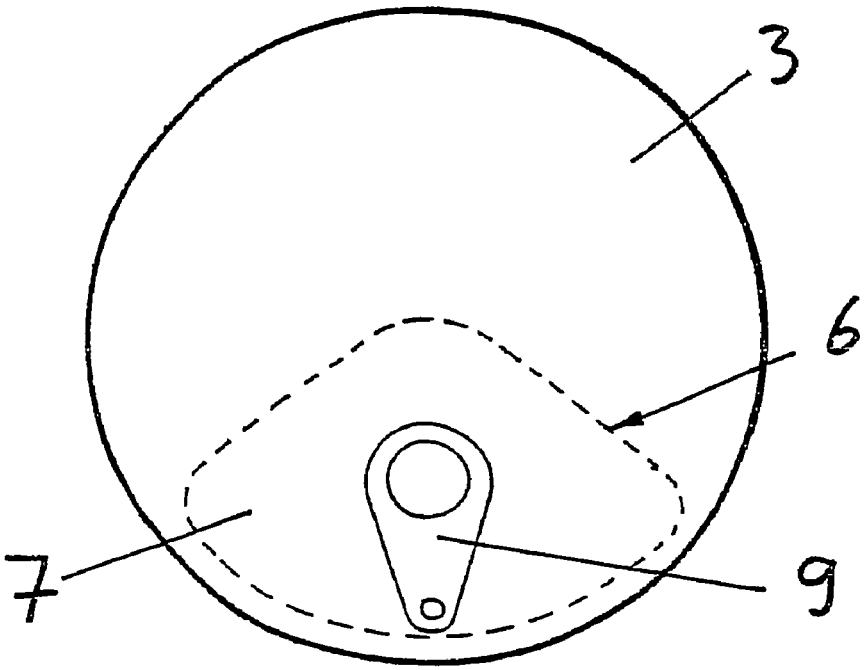
Figure 15:
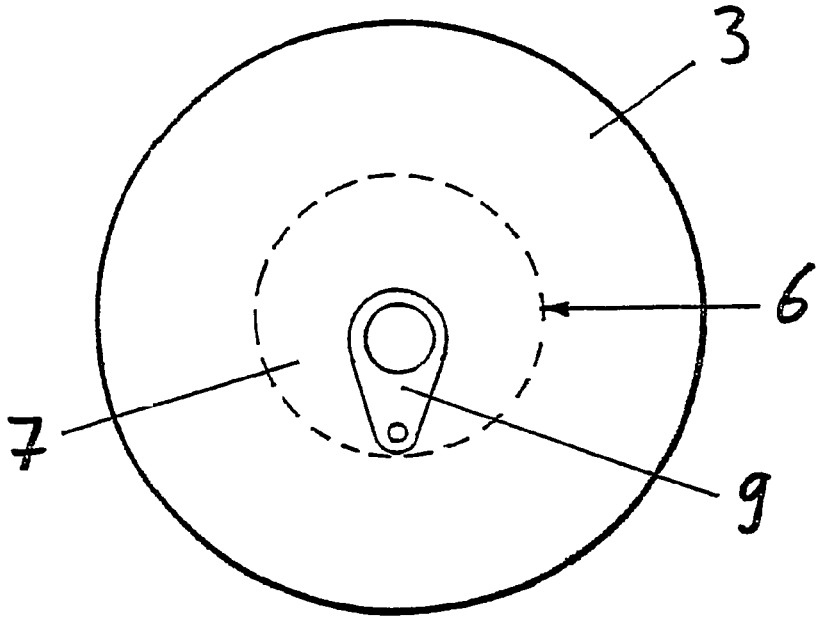
Figure 16:
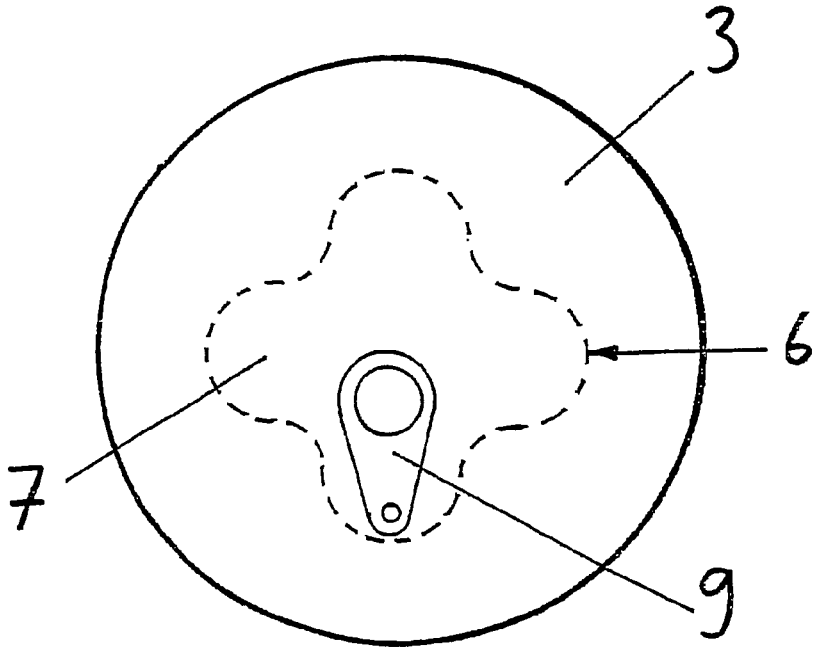

As can be taken from the predetermined breaking locations 6 illustrated by broken lines, the cover lids 3 of the fuel cans illustrated in the FIGS. 13 to 16 in each case comprise exactly one completely detachable cover portion element 7, whereby they differ from each other regarding the shape or arrangement, respectively, of same (FIG. 13 circle located at the edge of the cover, FIG. 14 section of a circle located at the edge of the cover, FIG. 15 circle located in the center of the cover, FIG. 16 free shape located in the center of the cover). Correspondingly, the detaching of the lid portion 7 leads to opened fuel cans with differing opening patterns, which represent burners with differing characteristics.

The free shape illustrated in FIG. 16 consists of identical round flaps arranged uniformly around a center and comprises four axes of symmetry, which intersect in a vertical axis through the center of the can body 1 and has the advantage that the correspondingly shaped opening, which results after the detaching, has an area-wise dominant center which is surrounded by four flap form elements which extend radially outwards, wherewith in operation the center forms the burner opening and the outer flap areas serve for the air supply. Also this burner geometry promotes a stable flame and a uniform combustion of the fuel.

Figure 17:
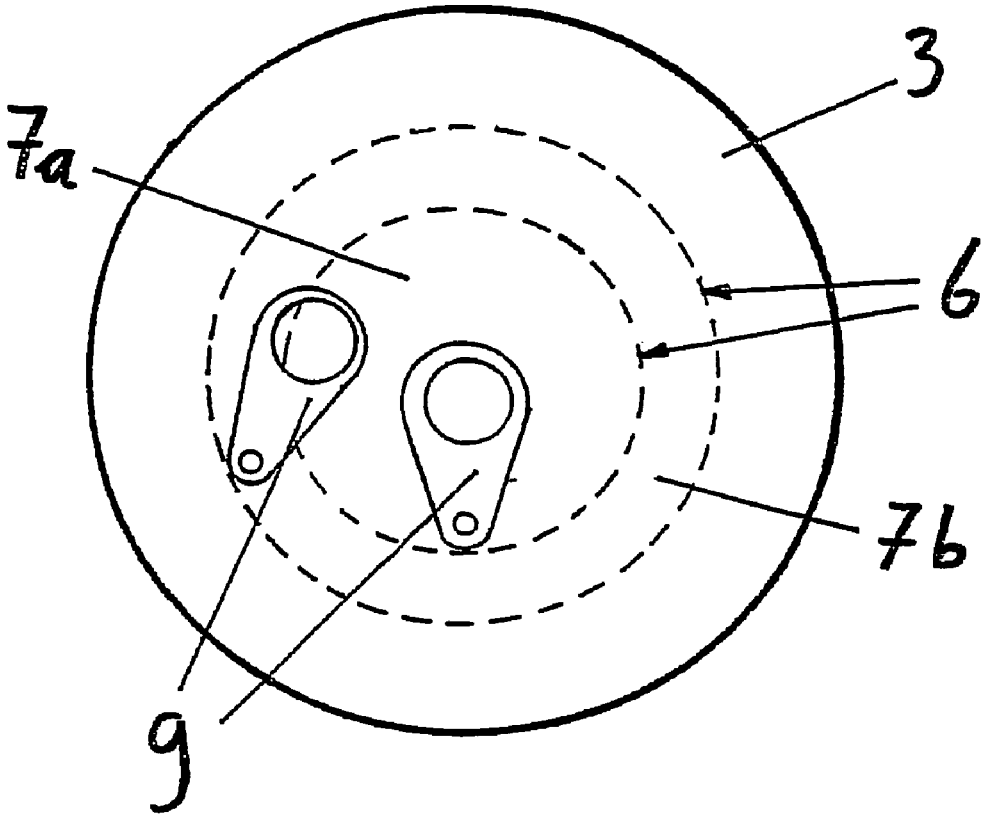

As can be taken from the predetermined breaking locations 6 illustrated by broken lines in FIG. 17, the cover lid 3 of this fuel can is designed, as already at the fuel can according to FIG. 11, in such a manner that depending from a desired burner rating and combustion duration either the circular central cover portion element 7*a* (for a smaller burner rating and a longer duration of combustion) or the annular shaped cover portion element 7*b* (for a higher burner rating and a shorter duration of combustion), which is surrounding the cover portion element 7*a*, can be detached, whereby in the latter case the cover portion element 7*a* is automatically detached together with the cover portion element 7*b*. After the detaching, in both cases an opening geometry as in FIG. 15 is arrived at, however with opening areas of different sizes.

FIGS. 18 to 21 illustrate top views onto further fuel cans according to the invention, at which the cover lids 3 are equipped with lid portion elements 7 with pulling tabs 8 structured as peel-off foil elements 5, which after the peeling off expose the openings in the cover lid which are indicated here by broken lines. The predetermined breaking locations 6 are formed in this embodiment by the glueing between the peel-off foil element 5 and the supporting surface and are, therefore, not directly visible in the top view.

Figure 18:
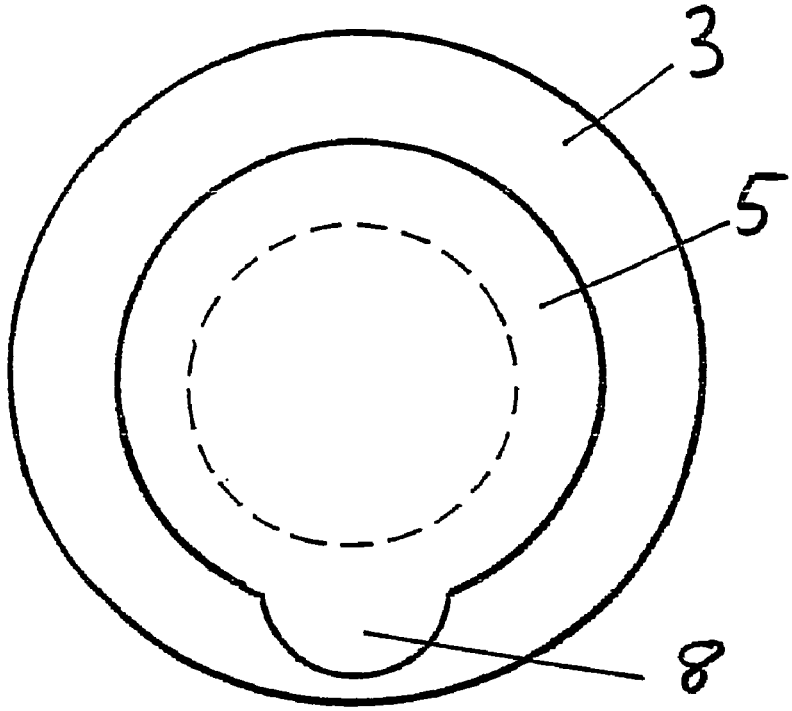
FIG. 18 to FIG. 21 top views onto further fuel cans according to the invention with cover lids with peel-off foil elements.
Figure 19:
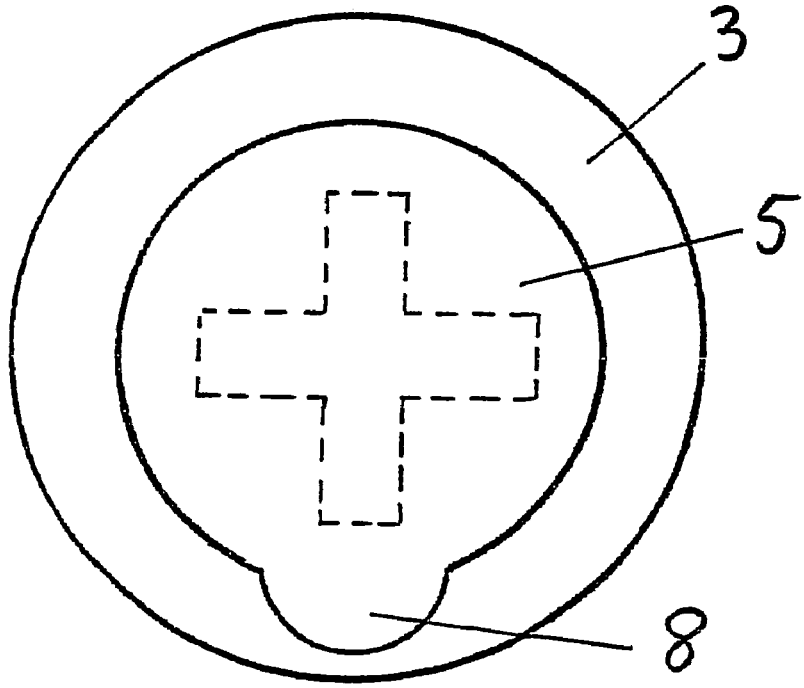

At the fuel cans of FIGS. 18 and 19, the actual cover lid 3 consists of a sealing foil or a sheet metal with the desired opening (FIG. 18 circular opening in the center, FIG. 19 cross-shaped opening in the center), whereby the opening is hidden by a glued on peel-off foil element 5.

Figure 20:
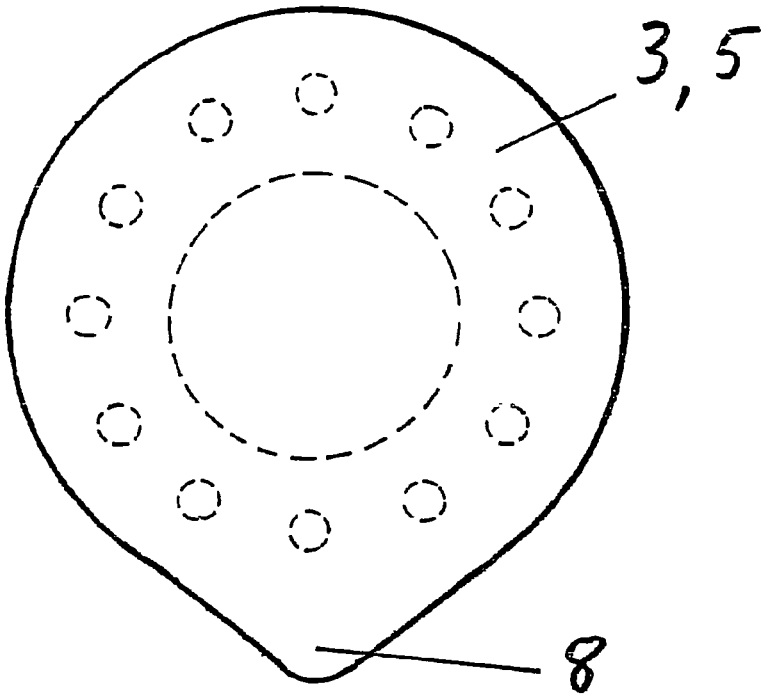
Figure 21:
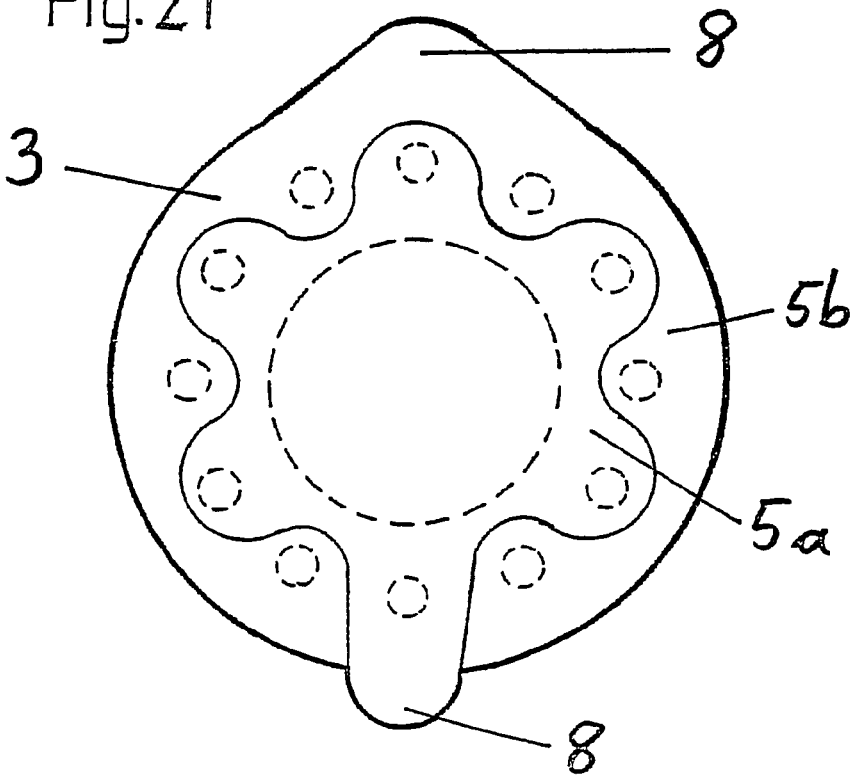

The lids of the fuel cans according to the FIGS. 20 and 21 are produced by a multi-layer sealing foil with a peel-off foil lid layer, so that the peel-off foil element(s) 5, 5*a*, 5*b* extend over the entire cover lid 3. The openings in the lid material that remains after the removing of the peel-off foil elements 5, 5*a*, 5*b*, which are illustrated by broken lines have been produced by a punching through all foil layers except the peel-off lid foil layer. By a peeling of the peel-off foil elements 5, 5*a*, 5*b*, the punched foil parts are removed together with same.

As can be derived by the continuous thin line in the lid surface in FIG. 21, which shows a punching of merely the peel-off foil layer of the illustrated cover lid 3, the lid 3 of the fuel can illustrated in this Figure comprises two peel-off foil elements 5*a*, 5*b* arranged substatially concentrically relative to each other, whereby depending from the desired burner rating and duration of combustion either only the central peel-off foil element 5*a* (for a lower burner rating and a longer duration of combustion) or both peel-off foil elements 5*a*, 5*b* (for a higher burner rating and a shorter duration of combustion) can be removed. By a peeling-off of the central peel-off foil element 5*a*, a central circular burner opening and a few smaller circular air supply openings surrounding this burner opening in a uniform pitch are exposed, wherewith the opening pattern of a basic burner is arrives at. If additionally the peel-off foil element 5*b* is peeled off, additional air supply openings of the kind described above are exposed, wherewith an opening pattern of a burner with increased burner rating is arrived at.

Figure 22:
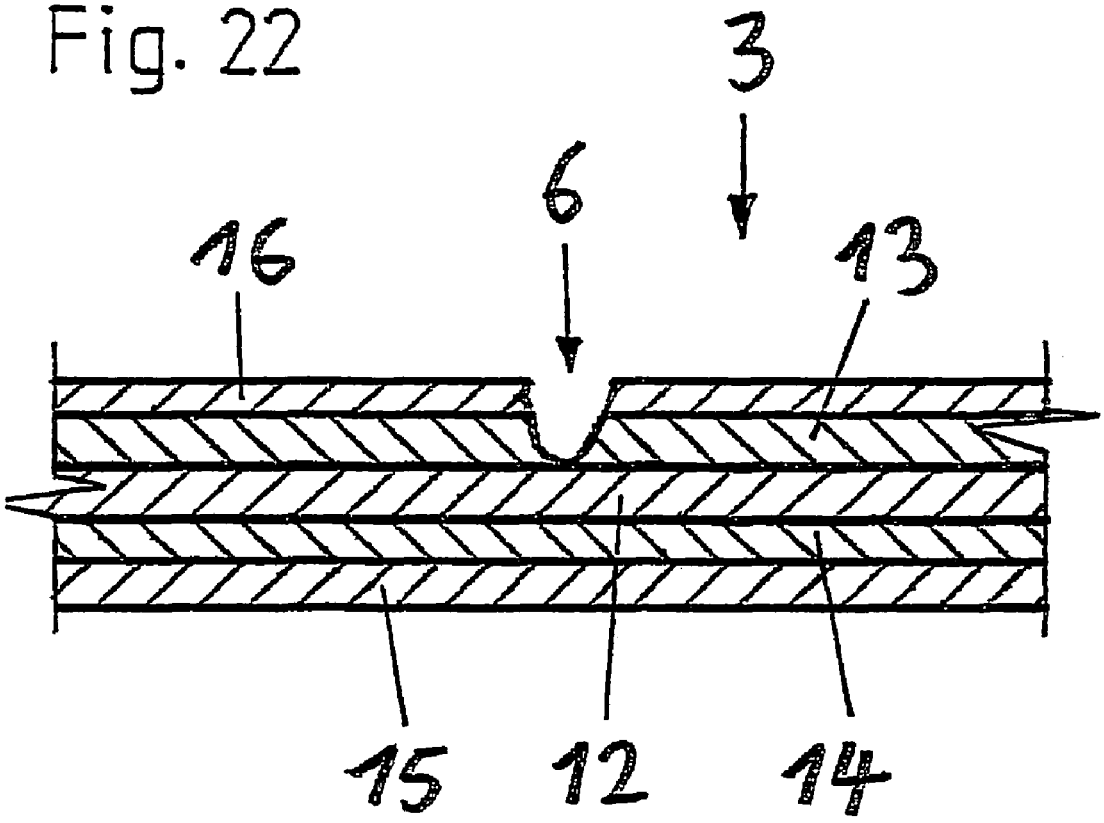
FIG. 22 a section not true to scale through the sealing foil lid of a fuel can according to one of the FIGS. 1 to 12.

FIG. 22 illustrates a section not true to scale through a cover lid 3 according to the invention made of a sealing foil according to the invention. Such a cover lid 3 is also illustrated in the FIGS. 1 to 12. As can be seen, the sealing foil, from which the cover lid 3 is formed, consists of two aluminum foils 13, 14 of a thickness of about 30 μm, which are interconnected with each other by a PE-layer 12 (polyethylene-layer) of the same thickness. The aluminum foil 14 facing the can body 1 is continuous and carries at its side facing the can body 1 a sealing layer 15, by means of which the cover lid 3 is sealed onto the flange of the can body 1 (not illustrated). The aluminum foil 13 comprises at its side facing away from the can body 1 an imprint 16 and is interrupted in the area of the predetermined breaking location 6, which in the present case has been obtained by a burning off of material by means of a laser.

Whereas preferred embodiments of the invention are described in the present invention it shall be clearly understood that the invention is not limited to same but can also otherwise be embodied within the scope of the following claims. In particular it is possible to combine various embodiments and various fuel fillings can be applied, with solid or liquid or gel-like fuels, respectively, whereby the fuel filling can include e.g. also absorbent carrier materials for an immoblilization and/or as wick for the fuel as well as also single wicks. Attention shall also be drawn to the fact that the invention is not limited to stoves, but encompasses fuel cans for all imaginable uses as thermal, heat and light source within the scope of the following claims.

The invention claimed is:

1. A fuel can, comprising:

a can body containing a fuel filling, the can body including a flange rim; and a cover lid which is formed by a sealing foil, the sealing foil including a sealing layer sealed to the flange rim of the can body thereby permanently sealing the cover lid to the can body, two metal foils, and a synthetic material layer located between the metal foils, the two metal foils and the synthetic material layer being provided above the sealing layer;

wherein the cover lid is configured such at least one opening in the cover lid is producable by a complete or partial severing or detaching of one or more lid portion elements of the sealing foil, each lid portion element including the sealing layer, the synthetic material layer, and the two metal foil layers, along one or several material bonded predetermined breaking locations, wherein, an upper metal foil of the two metal foils is weakened or interrupted along the predetermined breaking locations, and a lower metal foil of the two metal foils, which faces the can body, and the sealing layer are continuous but configured to break in the area of the predetermined breaking locations.

2. The fuel can according to claim 1, wherein at least a part of the severable or detachable lid portion elements are designed as peel-off foil elements, and are formed by a peel-off foil element extending across the entire cover lid.

3. The fuel can according to claim 1, wherein at least a part of the severable or detachable lid portion elements is designed as a sub-area which is detachable from the cover lid.

4. The fuel can according to claim 1, wherein the severable or detachable lid portion elements are equipped with opening aid means comprising a pulling flap or a pulling ring in order to facilitate a severing or detaching of same, and the opening aid means are designed in such a manner that they project over an outer border of the fuel can and may be gripped by hand.

5. The fuel can according to claim 1, wherein the cover lid is designed in such a manner that by the severing or detaching of the lid portion elements, openings with an opening pattern with at least two axes of symmetry are producable in the cover lid, and such opening patterns are producable of which the axes of symmetry intersect in a vertical axis through the center of the can body.

6. The fuel can according to claim 1, wherein the cover lid is designed in such a manner that the severing or detaching of the lid portion elements causes an irreversible elimination of the material bond along the predetermined breaking locations.

7. The fuel can according to claim 1, wherein the can body is a deep drawn cup or a deep drawn bowl of aluminum or tin plate.

8. The fuel can according to claim 1, wherein the fuel filling consists of a fuel paste with or without wick, comprised of thickened ethyl alcohol, isopropanol, or methanol without wick.

9. The fuel can according to claim 1, wherein the fuel filling consists of a fuel with or without wick which is solid at room temperature, comprised of polyethylene glycols, stearin, paraffin, hydrocarbon-derivates, waxes, wax-like fuels or their derivates, resp., or of a mixture thereof as well as a wick.

10. The fuel can according to claim 1, wherein the fuel is a fuel which is solid at room temperature, and is comprised of polyethylene glycol.

11. The fuel can according to claim 1, wherein after the complete severing of the predetermined breaking locations, the severable or detachable lid portion elements remain undetachably connected at the cover lid.

12. The fuel can according to claim 1, wherein the cover lid is designed in such a manner that by a severing or detaching of one or several lid portion elements, various openings and/or a differing number of openings are selectively producable in the cover lid.

13. The fuel can according to claim 1, wherein the cover lid is designed in such a manner that by the severing or detaching of the lid portion elements a center opening, which has substantially the same shape as the surface of a fuel filling in the can body at a medium level of fill and is concentrically arranged relative to same, and one or several strip shaped opening pattern elements, which are extending radially outwards from same, in particular up to the edge of the cover lid, and smoothly pass into the central opening, are produceable in the cover lid.

14. A use of the fuel can according to one of claims 1 and 11-13 as a thermal, heat, or light source, as a burner for a stove, or as a lamp.

15. A heat and light source comprising the fuel can according to one of claims 1 and 11.

16. The fuel can according to claim 1, wherein the two metal foils are aluminum foils, and the synthetic material layer is a polyethylene layer.

17. The fuel can according to claim 1, wherein the lower metal foil and the sealing layer are continuous across an entire area of the foil and layer, respectively.

18. The fuel can according to claim 1, wherein the fuel filling consists of a fuel received in an absorptive, cotton or fleece like material, and the absorptive material during the burning of the fuel has the function of a wick.

19. The fuel can according to claim 18, wherein the fuel is a fuel which is liquid at room temperature, and is comprised of diethylene glycol.

20. The fuel can according to claim 1, wherein the cover lid is designed in such a manner that by the severing or detaching of the lid portion elements, a center opening is producable in the cover lid which has substantially the same shape as the surface of a fuel filling in the can body at a medium level of fill and is concentrically arranged relative to same.

21. The fuel can according to claim 20, wherein a substantially circular or quadratic center opening is producable, and in particular, in that it comprises an area which corresponds to at least 15% of the surface area of a fuel filling in the can body at a medium level of fill.

22. The fuel can according to claim 20, wherein by a severing or detaching of the cover portion element, further small circular openings are producable in the cover lid in addition to the central opening, which surround the center opening concentrically and with a uniform pitch.

23. The fuel can according to claim 20, wherein by the severing or detaching of the lid portion elements, in addition to the central opening one or several strip shaped opening pattern elements are producable which are extending radially outwards from same, which are extending up to the edge of the cover lid.

24. The fuel can according to claim 23, wherein the radially outwards extending strip shaped opening pattern elements pass smoothly into the central opening, and the center opening forms together with such a radially outwards extending strip shaped opening element a pear-shaped opening.

25. The fuel can according to claim 23, wherein two such strip shaped opening pattern elements are producable which are located precisely opposite of each other.

* * * * *